US010512580B2

(12) United States Patent
Chung

(10) Patent No.: US 10,512,580 B2
(45) Date of Patent: Dec. 24, 2019

(54) CHIROPRACTIC DEVICE

(71) Applicant: Kun-Yen Chung, Tainan (TW)

(72) Inventor: Kun-Yen Chung, Tainan (TW)

( * ) Notice: Subject to any disclaimer, the term of this patent is extended or adjusted under 35 U.S.C. 154(b) by 551 days.

(21) Appl. No.: 15/273,720

(22) Filed: Sep. 23, 2016

(65) Prior Publication Data

US 2017/0151117 A1 Jun. 1, 2017

(30) Foreign Application Priority Data

Nov. 27, 2015 (TW) ..... 104139784 A

(51) Int. Cl.
*A61H 1/00* (2006.01)

(52) U.S. Cl.
CPC ..... *A61H 1/008* (2013.01); *A61H 2201/1623* (2013.01); *A61H 2203/0456* (2013.01)

(58) Field of Classification Search
CPC . A61H 1/008; A61H 1/00; A61H 1/02; A61H 1/0292; A61H 37/00; A61H 37/07; A61H 2201/0138; A61H 2201/1284; A61H 2201/0192; A61H 2201/168; A61H 2201/0107; A61H 2201/1609; A61H 2201/1604; A61H 2201/1623; A61H 2201/0142; A61H 2205/081; A61H 2203/0456; A61G 13/009; A61G 13/12; A61G 13/225; A47C 20/00; A47C 20/027
USPC ..... D24/183, 184; D6/601
See application file for complete search history.

(56) References Cited

U.S. PATENT DOCUMENTS 4,686,968 A * 8/1987 Scherger ..... A61H 1/008 100/226
5,070,865 A * 12/1991 Iams ..... A47G 9/10 128/DIG. 20
5,279,310 A * 1/1994 Hsien ..... A61F 5/01 128/DIG. 20
5,498,233 A * 3/1996 Stojanovic ..... A41D 13/0512 128/845
5,820,573 A * 10/1998 Ramos ..... A61H 7/001 601/134
7,083,234 B2 * 8/2006 Dowty ..... B60N 2/62 297/230.14
8,316,855 B2 * 11/2012 Lee ..... A61H 7/001 128/845
2010/0056964 A1 * 3/2010 Summers ..... A61H 1/0292 601/49
2016/0324711 A1 * 11/2016 Richmond ..... A61G 13/121

* cited by examiner

*Primary Examiner* — Timothy A Stanis
*Assistant Examiner* — Matthew R Moon
(74) *Attorney, Agent, or Firm* — Leong C. Lei

(57) ABSTRACT

The chiropractic device includes an elongated flat base, and a front stopping block and a back stropping block at the base's two ends. The front and back stopping blocks have a semi-circular cylindrical shape, with 45-degree slant support face on one end and a vertical face on the other end. Between the front and back stopping blocks, there are a main block and a number of stopping plates of different lengths. Along a top edge of the front and back stopping blocks, the main block, and the stopping plates, an end-to-end trough is provided. The chiropractic device is able to adapt its length so that users of different heights may lie on the chiropractic device for spinal relaxation and correction to the spine.

9 Claims, 8 Drawing Sheets

CHIROPRACTIC DEVICE

BACKGROUND OF THE INVENTION (a) Technical Field of the Invention

The present invention is generally related to chiropractic, and more particular to a chiropractic device for relaxing spine and assisting spine rehabilitation and correction.

(b) Description of the Prior Art

Modern people suffer many civil diseases due to bad living habits, lack of exercise, faulty postures, etc. Among them, the deformation of the vertebral column, scoliosis, etc. are common ones. These diseases often cause significant pain and therefore there are many chiropractors and various assistive spine correction and rehabilitation devices. These assistive devices often provide hanging or pulling mechanisms for relaxing the vertebraes. For example, R.O.C. Taiwan Patent No. M461418 teaches a spinal correction device where a user's head is dragged and pulled while the user is seated so as to achieve correction by reducing and relieving the pressure on an upper section of the spine. This kind of treatments, regardless of whether the user is seated or laid down, has to be adapted to apply a different force (including gravity) in accordance with individual user's symptom (e.g., whether scoliosis has already occurred) and endurance. Usually repeated or incremental tests have to be conducted so as to determine a right degree of force. This process usually takes a long time and the effect is not obvious. Too hard a pulling may even lead to secondary damage. Therefore R.O.C. Taiwan Patent No. 527917 teaches a spinal correction rack where a user lies on a number of lateral beams running across a pair of frames, and magnetic elements and rubber sleeves are integrated. This teaching relies on the user's weight as correction force and the spinal correction is mainly provided by the protruding rubber sleeves and magnetic elements. It usually requires experienced technical persons to adjust or arrange the protruding rubber sleeves and magnetic elements. Otherwise the spinal correction is not easy to achieve. This is because the spine runs in an indented middle part of the back. Without appropriate support, spinal correction is of limited effect. Considering that scoliosis is so common to modern people, especially office workers, who fail to maintain an upright posture, cross their legs, or slouch in the chair while spend too much time sitting. Without appropriate correction, deformation and damage to the spine or even hip joint is possible. The main cause is that the spine is not well treated. Therefore, a simple and convenient spinal assistive device without relying on experienced personnel would be of urgent need to modern people's lives and health.

SUMMARY OF THE INVENTION

The chiropractic device includes an elongated flat base, and a front stopping block and a back stropping block at the base's two ends. The front and back stopping blocks have a semi-circular cylindrical shape, with 45-degree slant support face on one end and a vertical face on the other end. Between the front and back stopping blocks, there are a main block and a number of stopping plates of different lengths. Along a top edge of the front and back stopping blocks, the main block, and the stopping plates, an end-to-end trough is provided.

A user directly lies on the chiropractic device so that the chiropractic device is right beneath the user's spine. The user's neck/head and hip are supported by the slant front and back support faces, and the two ends of the user's spine are pulled by the user's own weight. The user's spine is as such naturally stretched, thereby achieving spinal rehabilitation and correction. The semi-circular main block and stopping plates slightly raise the user's upper torso and outward expand the user's chest. The length of the chiropractic device is adaptable to fit different users. The trough accommodates the spine, especially the bony spurs, without causing pain or uncomfortable feeling of oppression.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
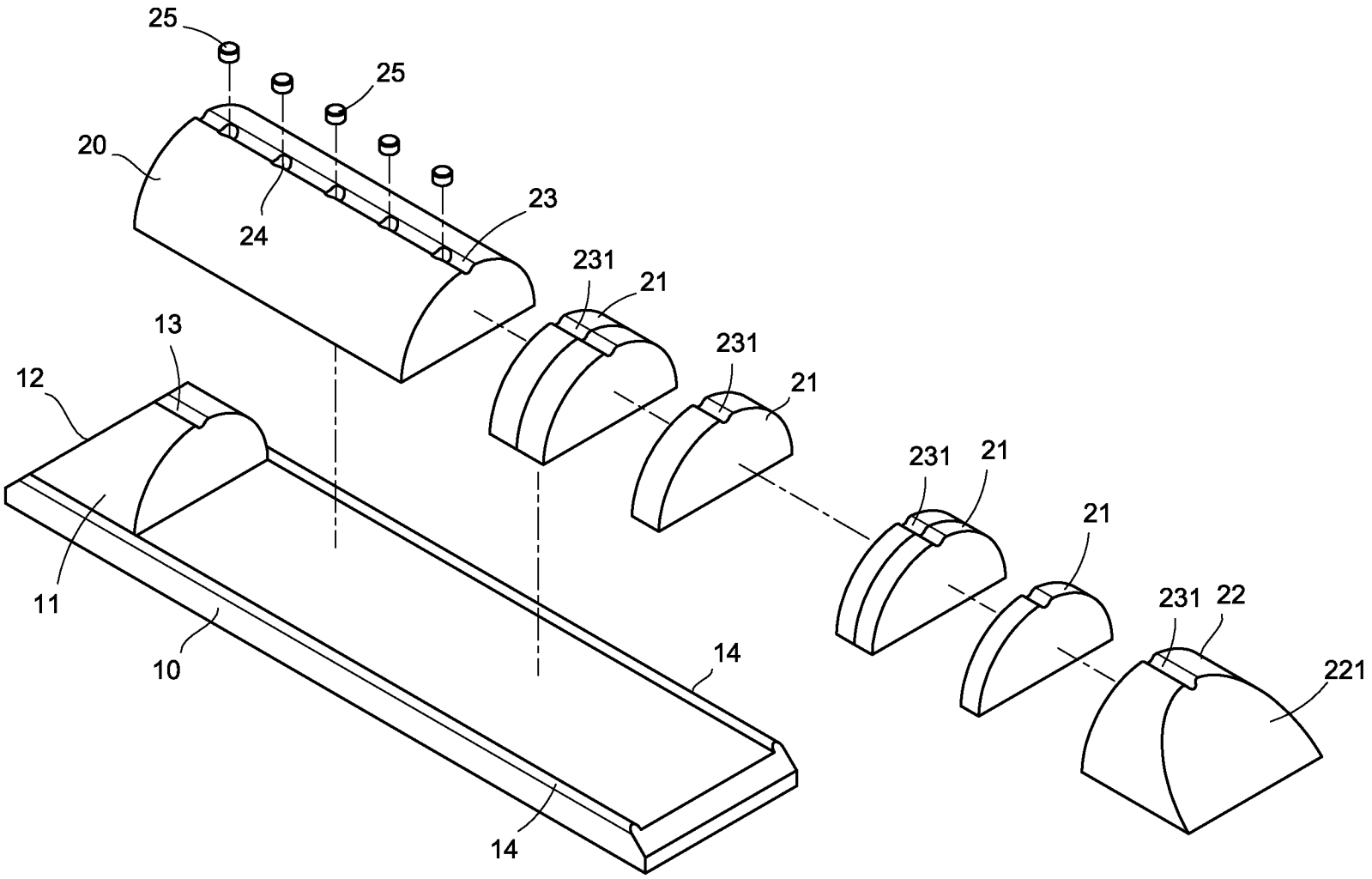
FIG. 1 is a perspective break-down diagram showing a chiropractic device according to an embodiment of the present invention.
Figure 2:
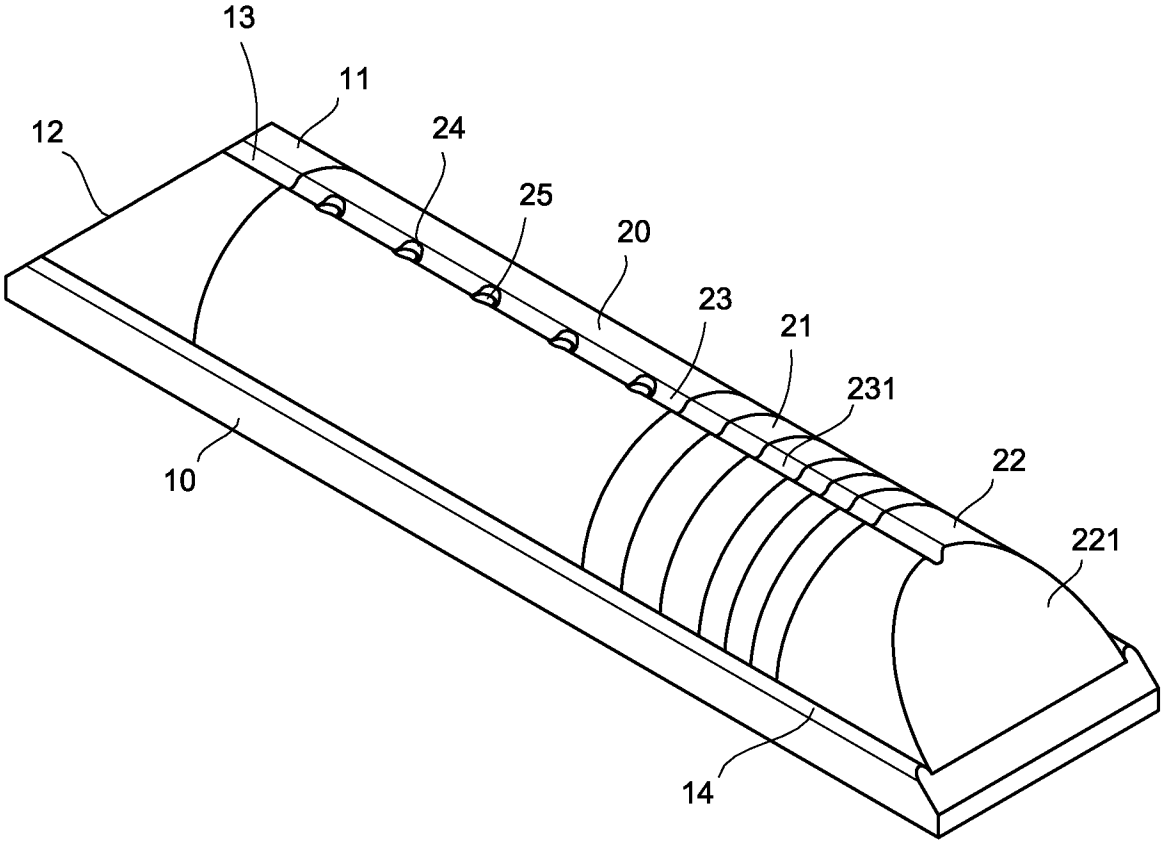
FIG. 2 is a perspective diagram showing the chiropractic device of FIG. 1 after assembly.
Figure 3:
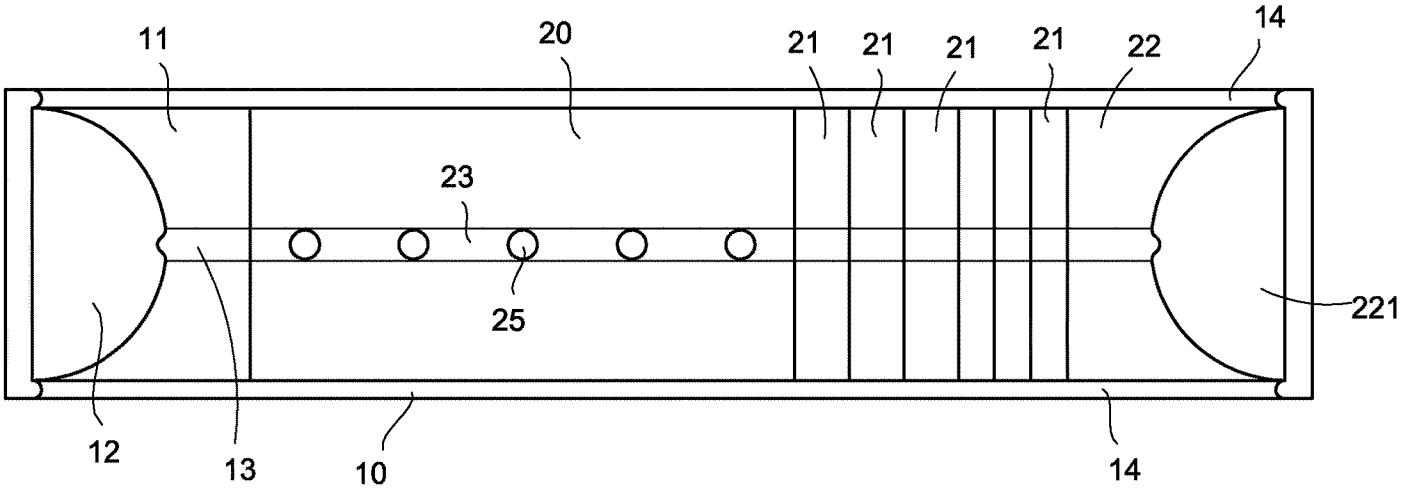
FIG. 3 is a top-view diagram showing the chiropractic device of FIG. 1
Figure 4:
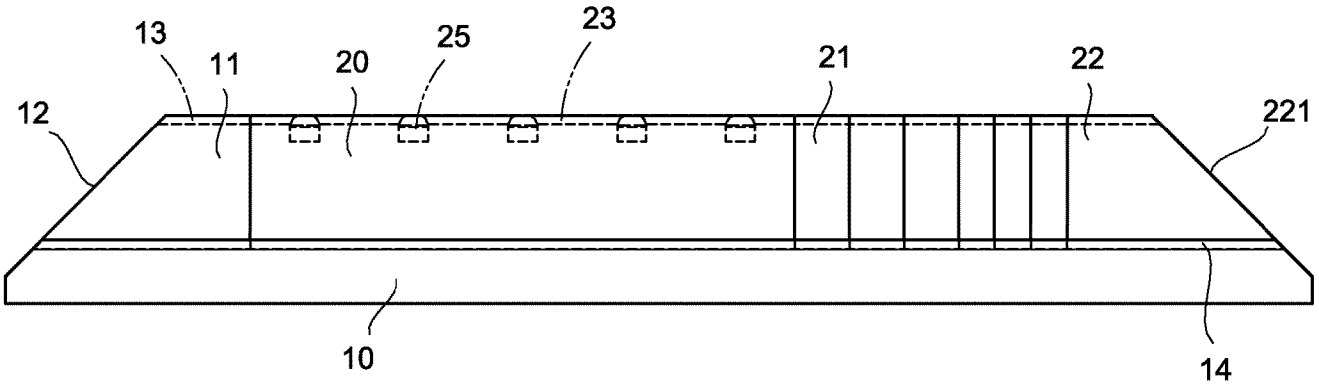
FIG. 4 is a schematic profile diagram showing the chiropractic device of FIG. 1.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

The present invention provides a chiropractic device assisting spine correction without applying external forces. As shown in FIGS. 1 to 9, the chiropractic device according to an embodiment of the present invention includes an elongated and flat base 10. An upward protruding front stopping block 11 is disposed at a front section on a top side of the base 10. The front stopping block 11 has a slant front support face 12 at a front end. The front support face 12 has a 45-degree included angle with the base 10 and a front edge aligned with that of the base 10. The front stopping block 11 has a semi-circular flat face (not numbered) at a back end perpendicular to the base 10. The front stopping block 11 overall has a roughly semi-circular cylindrical shape. The radius of the flat face generally is 7.5 cm for better ergonomics. It may vary between 7.5 cm and 10 cm depending on the height of a user. The overall height of the front stopping block 11 together with the base 10 is preferably between 10.5 cm and 13 cm so as to conveniently raise a user's back and to achieve appropriate chest expansion. The base 10 has a length generally between 70 cm and 80 cm to fit users of different heights. The front stopping block 11 has a trough 13 extended along a top edge from the front support face 12 to the flat face. The trough 13 has a U-like cross section. There are two walls 14 arranged in parallel along two main edges of the top side of the base 10, respectively. Therefore a track-like indentation is formed between the walls 14 for the placement and positioning of components such as a main block 20, stopping plates 21, a back stopping block 22, etc. in between. The main block 20 has a semi-circular cylindrical shape with front and back flat faces perpendicular to the base 10. A front flat face is attached to the front stopping block 11. The man block 20 has a length between 30 cm to 32 cm and functions as the main support and correction part for spine. There are a number of stopping plates 21 of an identical cross-sectional shape to that of the main block 20 but of different lengths. The stopping plates 21 have lengths between 2 cm to 5 cm so that they are not too thin and deformed easily. Depending on a user's height and his/her spine length, stopping plates 21 of different lengths are selected and positioned sequentially within the indentation. The back stopping block 22 is structured symmetrically to the front stopping block 11 and is disposed at a back section on the top side of the base 10. The back stopping block 22 therefore also has a slant back support face 221 so that the chiropractic device of the present embodiment has slant front and back support faces 12 and 221 at the front and back ends, respectively. The main block 20, the stopping plates 21, and the back stopping block 22 all have end-to-end troughs 23 and 231 along their top edges. The troughs 13, 23, 231 are aligned and have identical cross-sectional shape so that they jointly form a single trough extended from one end of the chiropractic device to the other end. The front and back stopping blocks 11 and 22, the main block 20, and the stopping plates 21 are made of a relative hard yet flexible rubber of plastic material such as Ethylene-vinyl acetate (EVA), Polyurethane (PU) so that they will not be deformed under a user's weight but also provide comfortable contact. The hardness is between 60 and 80 Shore hardness. Alternatively, the front and back stopping blocks 11 and 22, the main block 20, and the stopping plates 21 may be covered with a soft flexible pad layer. In addition, the trough 23 of the main block 22 may be configured with a number of accommodation seats 24 at intervals where magnetic elements 25 are disposed so as to further provide rehabilitation effect. The accommodation seats 24 are of an appropriate depth so that the magnetic elements 25 do not bulge beyond the trough 23's top side so that they will not contact a user's back to cause any uncomfortable feeling.

Figure 5:
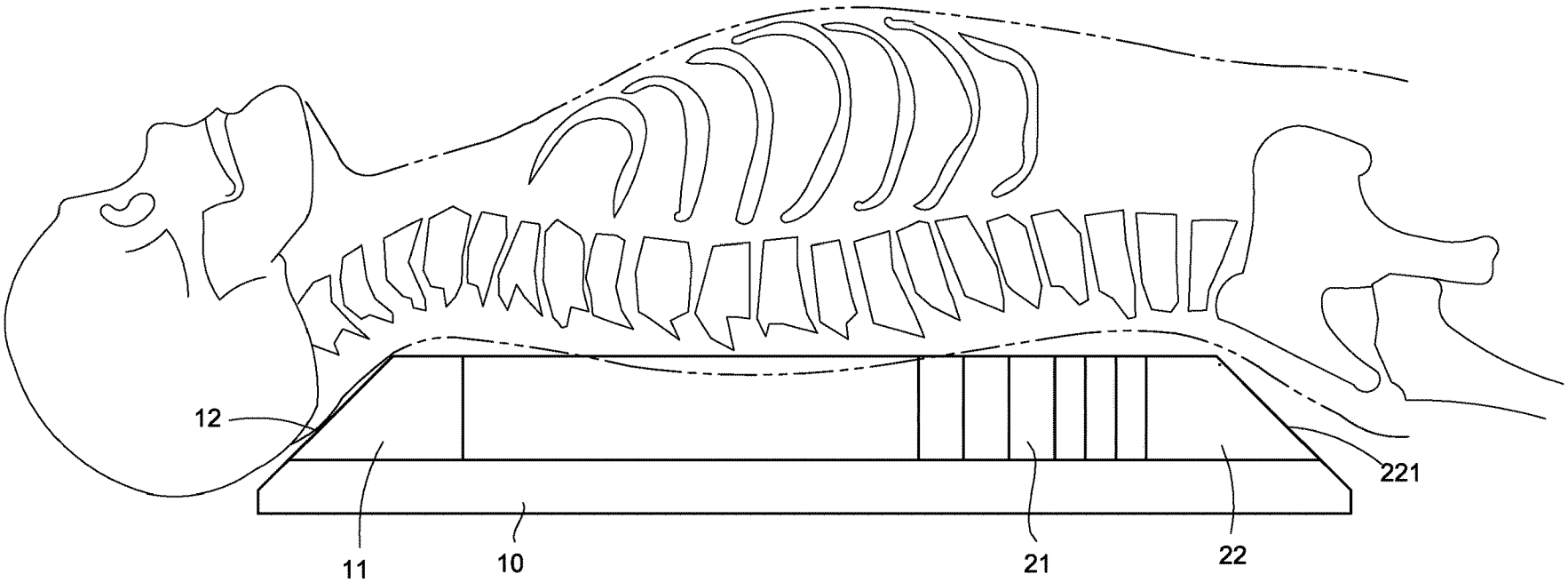
FIG. 5 is a schematic profile diagram showing a user lying on the chiropractic device of FIG. 1.
Figure 6:
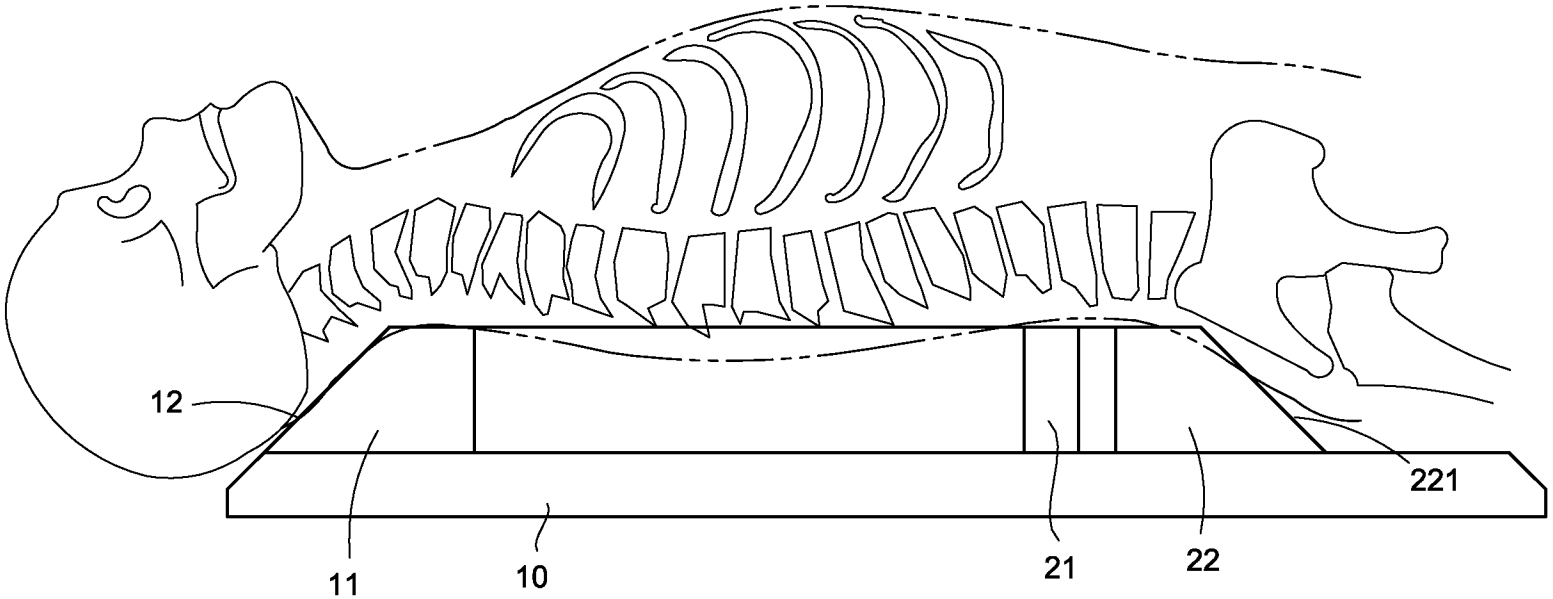
FIG. 6 is a schematic profile diagram showing another shorter user lying on the chiropractic device of FIG. 1.
Figure 7:
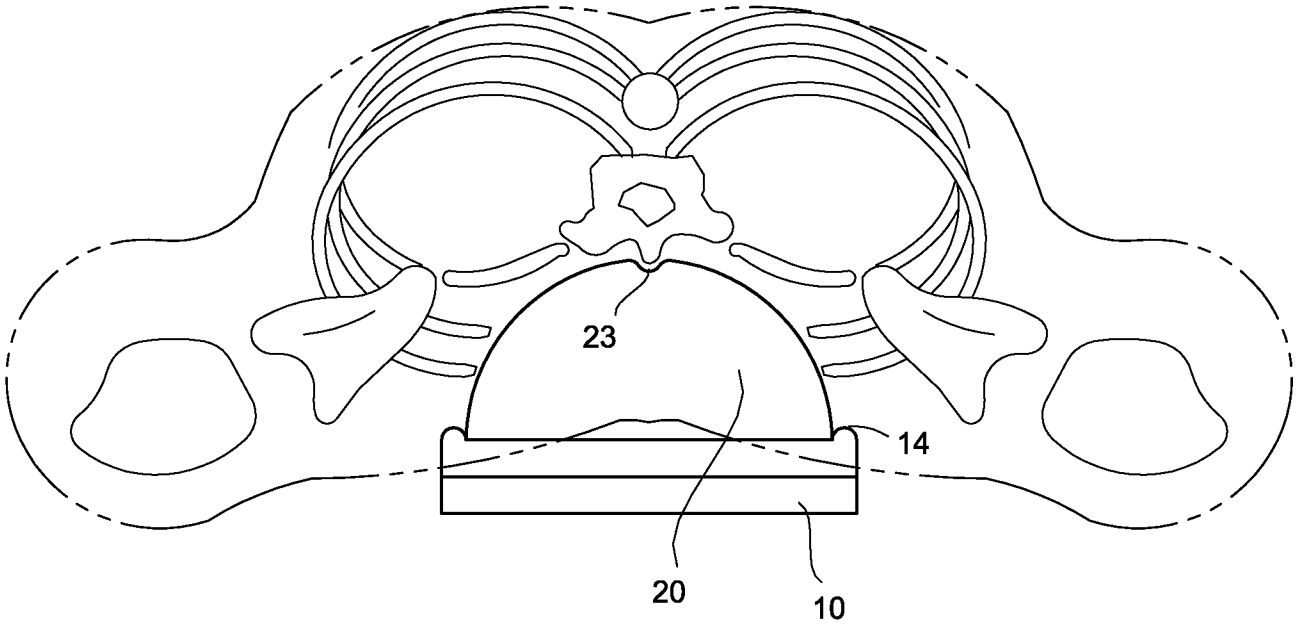
FIG. 7 is a schematic front-view diagram showing a user lying on the chiropractic device of FIG. 1.

To use the present embodiment, the present embodiment is placed on an elongated flat surface such as on a rehabilitation bed. An appropriate number of stopping plates 21 are assembled so that the present embodiment has an appropriate length according to the length of a user's upper torso. The user then directly lies on the present embodiment so that the present embodiment is right beneath the user's spine. As shown in FIGS. 5 to 7, the user's neck and head is supported by the front support face 12 of the front stopping block 11, and the head is pulled by gravity of its own weight. The head should not touch the elongated flat surface. On the other hand, the user's hip is supported by the back support face 221 of the back stopping block 22, and the hip's own weight provides a downward pull. As such, through the weights of the head and the hip, the user's spine is naturally pulled and stretched, thereby achieving rehabilitation and correction. In the meantime, the semi-circular main block 20 and stopping plates 21 slightly raise the user's upper torso and outward expand the user's chest as shown in FIG. 7, thereby achieving correction and restoration to the spines of patients with scoliosis. The aligned and cascaded troughs 23 and 231 accommodate the spine, especially the bony spurs, without causing pain or uncomfortable feeling of oppression. By constantly lying on the present embodiment, a normal person can conveniently prevent spinal deformation or damage, and achieve correction and care by himself/herself.

The greatest features of the present embodiment are as follows. The length of the present embodiment is adaptable to fit different users. The height of the present embodiment and the significantly slant support faces 12 and 221 provide pull to the two ends of a user's spine by the user's own weight. Without the application of external force, as common in the prior art, harm to the user may be prevented. The user can also vary his/her posture to adjust the pull. The height of the present embodiment is between 10.5 cm and 13 cm, and the user's upper torso is slightly raised. Therefore, if the user feels too strong a pull, he/she can easily turn the body slightly or use the elbow to press against the elongated flat surface to quickly lessen the pull for enhanced usage safety.

Figure 8:
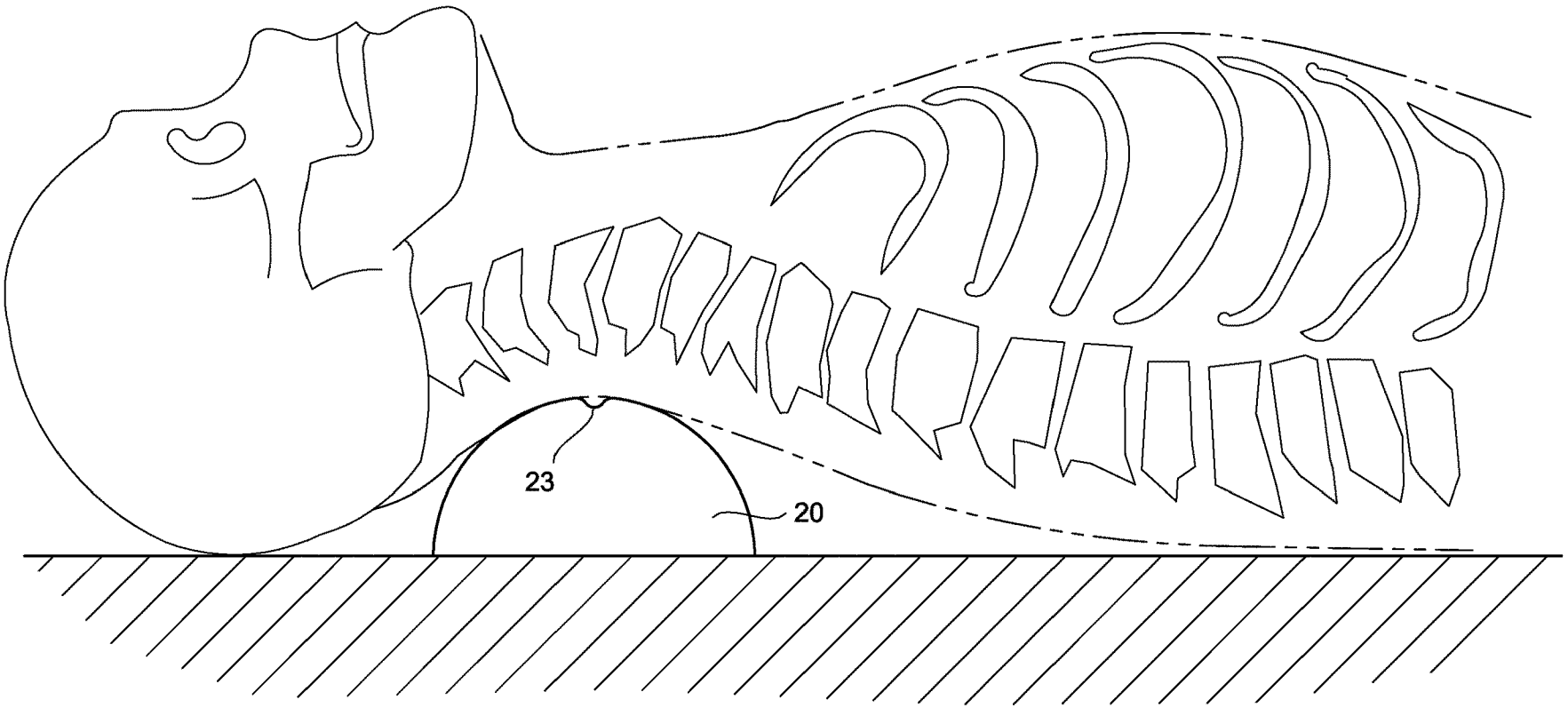
FIG. 8 is a schematic profile diagram showing a user has the neck supported by a main block of the chiropractic device of FIG. 1.
Figure 9:
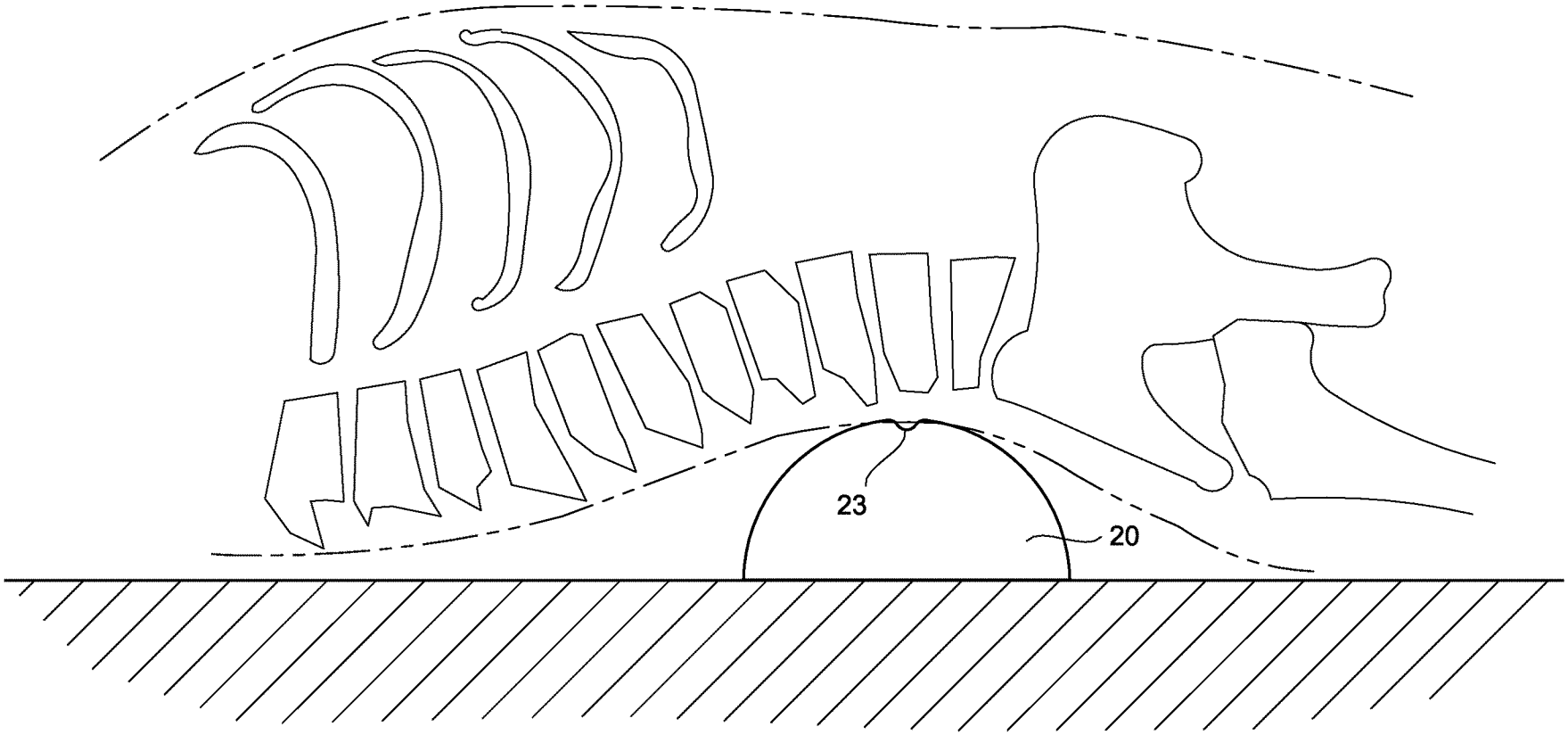
FIG. 9 is a schematic profile diagram showing a user has the waist supported by a main block of the chiropractic device of FIG. 1.

The main block 20 of the present embodiment may be used independently as shown in FIGS. 8 and 9. As illustrated, the main block 20 is placed on the elongated surface alone, perpendicular to the body's axis and underneath the neck or waist. The main block 20's semi-circular cylindrical shape and appropriate height provides comfortable support to the neck or waist. The main block 20 may also appropriately expand and relax the cervical vertebra. The length of the main block 20 also allows the user to turn over without falling off. The main block 20 therefore may function as a rehabilitation pillow, providing appropriate correction and rehabilitation to the waist and neck.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A chiropractic device, comprising an elongated flat base having two walls arranged in parallel along two main edges of a top side of the elongated flat base, forming an indentation in between;

a front stopping block disposed at a front section in the indentation where the front stopping block has a semi-circular cylindrical shape, a slant front support face at a front end at an included angle with the elongated flat base, and a flat face at a back end perpendicular to the elongated flat base, and a first trough extended along a top edge from the front support face to the flat face;

a main block in the indentation having a semi-circular cylindrical shape with front and back flat faces perpendicular to the elongated flat base and a second trough on a top edge aligned with the first trough where a front flat face is attached to the front stopping block;

a back stopping block in the indentation disposed at a back section in the indentation where the back stopping block has an identical semi-circular cylindrical shape as the front stopping block, a slant back support face at a back end at an included angle with the elongated flat base, and a flat face at a front end perpendicular to the elongated flat base, and a third trough extended along a top edge from the back support face to the flat face; and a plurality of stopping plates in the indentation between the main block and the back stopping block, each having an identical cross-sectional shape as the main block and a fourth trough on a top edge aligned with the first and second troughs.

2. The chiropractic device according to claim 1, wherein the front stopping block has a radius between 7.5 cm and 10 cm.

3. The chiropractic device according to claim 1, wherein the elongated flat base has a length between 70 cm and 80 cm.

4. The chiropractic device according to claim 1, wherein the first, second, third, and fourth troughs have a U-shaped cross section.

5. The chiropractic device according to claim 1, wherein the main block has a length between 30 cm and 32 cm.

6. The chiropractic device according to claim 1, wherein each of the stopping plates has a length between 2 cm and 5 cm.

7. The chiropractic device according to claim 1, wherein the front and back stopping blocks, the main block, and the stopping plates are made of a rubber or plastic material selected from a group comprising Ethylene-vinyl acetate (EVA) and Polyurethane (PU).

8. The chiropractic device according to claim 7, wherein the material has a Shore hardness between 60 and 80.

9. The chiropractic device according to claim 1, wherein the chiropractic device has a height between 10.5 cm and 13 cm.

* * * * *